US007900925B2

(12) United States Patent
Hextall et al.

(10) Patent No.: US 7,900,925 B2
(45) Date of Patent: Mar. 8, 2011

(54) STRATEGIC PATTERN BUILDING BOARD GAME

(75) Inventors: Toby Hextall, London (GB); Katharine Chapman, Berkshire (GB)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 12/254,694

(22) Filed: Oct. 20, 2008

(65) Prior Publication Data

US 2010/0096806 A1 Apr. 22, 2010

(51) Int. Cl.
*A63F 3/00* (2006.01)

(52) U.S. Cl. ..... 273/241; 273/271; 273/287; 235/64

(58) Field of Classification Search ..... 273/241, 273/264, 265, 260, 266, 287, 271; 434/168, 434/208; 235/64, 68, 136
See application file for complete search history.

(56) References Cited

U.S. PATENT DOCUMENTS 3,149,842 A 9/1964 Cirrincione
4,243,227 A * 1/1981 Strongin ..... 273/357
4,381,112 A * 4/1983 Dupuy ..... 273/239
5,154,428 A 10/1992 Woolhouse
5,971,269 A * 10/1999 Baguley ..... 235/68
6,513,708 B2 * 2/2003 Evans ..... 235/64
6,533,277 B1 3/2003 Yin
6,655,687 B2 * 12/2003 Sanchez-Seco ..... 273/271
D535,703 S 1/2007 Creech
D544,548 S 6/2007 Miller

FOREIGN PATENT DOCUMENTS

GB 2110097 A * 6/1983

* cited by examiner

*Primary Examiner*—Vishu K Mendiratta
(74) *Attorney, Agent, or Firm*—Perry Hoffman

(57) ABSTRACT

A game apparatus for an abstract strategy pattern building board game that has two walls, each with multiple apertures. A number of dividers are intermediate the two wall and form multiple channels disposed along the two walls. The dividers also form multiple gaps defined by spaces between the channels. Two sets of playing markers are used to build patterns during game play. One set of playing markers fills a single channel along one wall, and one set of playing markers fills two channels and a gap in between the two channels.

13 Claims, 11 Drawing Sheets

STRATEGIC PATTERN BUILDING BOARD GAME

BACKGROUND OF THE INVENTION

The present invention relates to a game assembly, and more particularly to a board game that involves abstract strategy pattern building for competition between two or more players.

For centuries board games have been an extremely popular form of entertainment for people of all ages. These types of games have been designed both for a single player and for competition between two or more players. Many games, such as Yahtzee™, mainly involve chance. Many games, such as backgammon, involve a combination of chance and skill, and many games, such as chess, mainly involve skill.

The present invention relates to games of skill that involve a competition between two or more players to build a desired pattern on the game board while preventing the other players from building the desired pattern. Popular games of this genre include Pente, gomoku, renju, and Milton Bradley's™ Score Four™.

Since 1974, the genre of pattern building games has included the very popular game of Connect Four™, a game also published by Milton Bradley™. A much older version of Connect Four™ is known as "The Captain's Mistress".

Connect Four™ is a two player game in which the players take turns dropping alternating colored discs into a seven column, six row vertically suspended matrix. The object of the game is to connect four singly-colored discs in a row, vertically, horizontally, or diagonally, before one's opponent can do likewise. Connect Four™ was created for players age seven and older and has an expected playing time of ten minutes. However, Connect Four™ is limited because only two players can play, because the suspended matrix only allows a player to insert the colored discs into a single plane, and because only one type of disc is used. Consequently, the difficulty and the enjoyment of the game are limited.

An abstract strategy pattern building game having a vertically suspended matrix that allows game pieces to be dropped into multiple planes, that uses varying types of game pieces, and that allows for more than two players is unknown in the prior art. Accordingly, it would be desirable to create a game that presents a variation in the aforementioned variables because the difficulty and the level of enjoyment of such a game would increase. The invention discussed in connection with the described embodiment addresses these and other deficiencies of the prior art.

The features and advantages of the present invention will be explained in or apparent from the following description of the preferred embodiment considered together with the accompanying drawings.

SUMMARY OF THE INVENTION

The present invention addresses the deficiencies of the prior art of abstract strategy pattern building games by expanding the limitations of a number of factors that are characteristic of that prior art. Particularly, the number of players that can play the game together is increased; the number of the dimensions in which patterns can be built is increased; the number of types of games pieces used is increased; consequently, the difficulty and the level of enjoyment of the prior art is increased.

While the prior art presents abstract strategy pattern building games for between two and four players and for pattern building in multiple dimensions, the prior art has not done so by presenting a game board assembly with a number of different types of game pieces that allow the players to simultaneously build patterns in more than one dimension.

A described embodiment of the invention provides a game board assembly as a vertically suspended matrix having multiple planes in which to build patterns by inserting game pieces (playing markers) into one or more of a number of planes. The described embodiment provides two types of game pieces, one for inserting the game piece into a single plane and one for inserting a game piece into multiple planes.

More particularly, the abstract strategy pattern building board game comprises a first wall having a multiplicity of first apertures and a second wall having a multiplicity of second apertures juxtaposed relative to said first wall. There is a multiplicity of first channels disposed along said first wall for receiving playing markers and a multiplicity of second channels disposed along said second wall for receiving playing markers. A plurality of dividers intermediate said first wall and said second wall define said multiplicity of first channels and said multiplicity of second channels. Said plurality of dividers are disposed to form a multiplicity of gaps defined by spaces between said multiplicity of first channels and said multiplicity of second channels.

The described embodiment further has two sets of playing markers. One set is such that a playing marker slides into either a first channel or a second channel. The second set is such that a playing marker simultaneously slides into a first channel, a second channel, and the gap between the first channel and the second channel. For each type of playing marker, there is a plurality of sets distinguishable by color. By sliding the playing markers into the channels, the players build patterns inside the vertically suspended matrix.

The described embodiment also has a first bracket and a second bracket slideably mounted to the top and the bottom of the vertically suspended matrix that are used to open and close the described channels. Thus, the brackets are used to allow the playing markers to slide into and out of the matrix and to hold the markers inside the matrix during game play and storage.

Lastly, the described embodiment has a foldable stand to support the matrix in an upright position. When the stand is unfolded it forms a compartment for catching the sets of playing markers. The stand then refolds to facilitate storage.

BRIEF DESCRIPTION OF THE DRAWINGS

The invention will now be more particularly described by way of example with reference to the accompanying drawings. Novel features believed characteristic of the invention are set forth in the claims. The invention itself, as well as the preferred mode of use, further objectives, and advantages thereof, is best understood by reference to the following detailed description of the embodiment in conjunction with the accompanying drawings, in which:

DESCRIPTION OF THE EMBODIMENTS

Figure 1A:
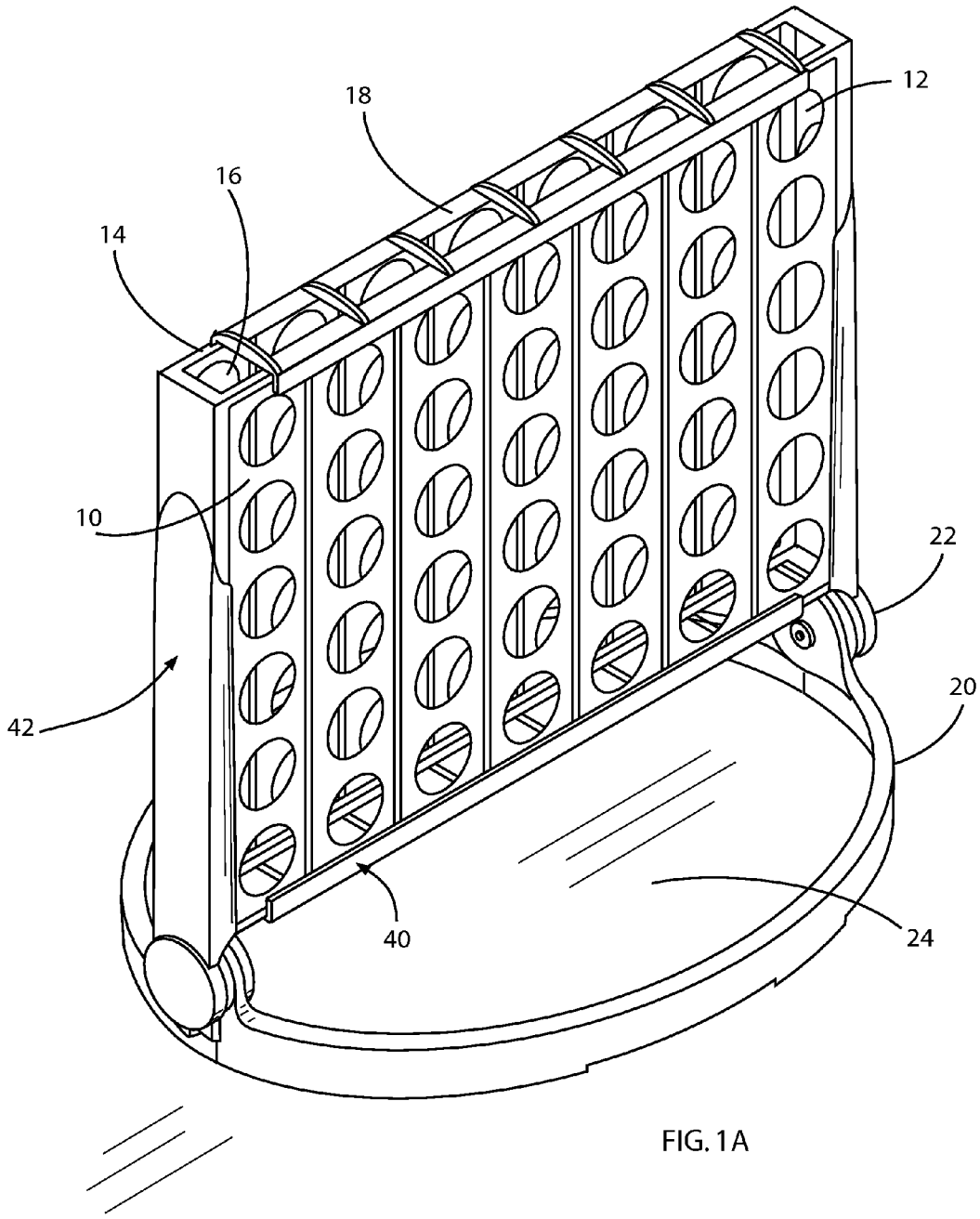
FIG. 1A shows a perspective view of the game assembly with the slideably mounted bracket in a closed position and the supporting stand in an unfolded position.

FIG. 1A shows a perspective view of the preferred embodiment of the abstract strategy pattern building board game. FIG. 1A shows the board game comprising a first wall 10 having a multiplicity of first apertures 12 and a second wall 14 having a multiplicity of second apertures 16 juxtaposed relative to said first wall 10. This figure shows said first wall 10 and said second wall 14 forming a vertically suspended matrix.

Figure 3:
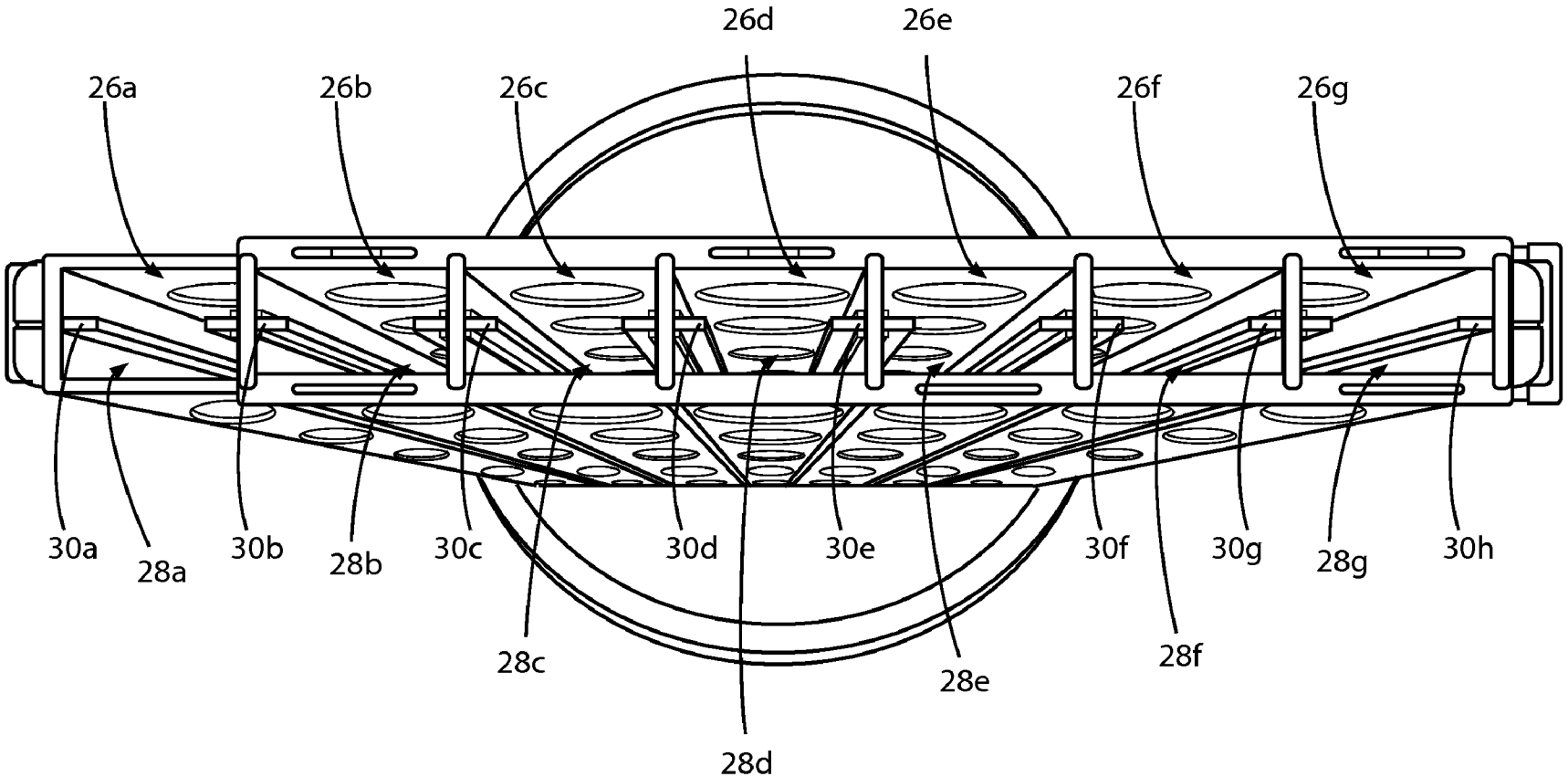
FIG. 3 shows a perspective view of the top of the game assembly.

FIG. 3 shows a perspective view of the top of the game assembly. FIG. 3 shows a multiplicity of first channels 26*a-g* disposed along said first wall 10 for receiving playing markers and a multiplicity of second channels 28*a-g* disposed along said second wall 14 for receiving playing markers.

Figure 4A:
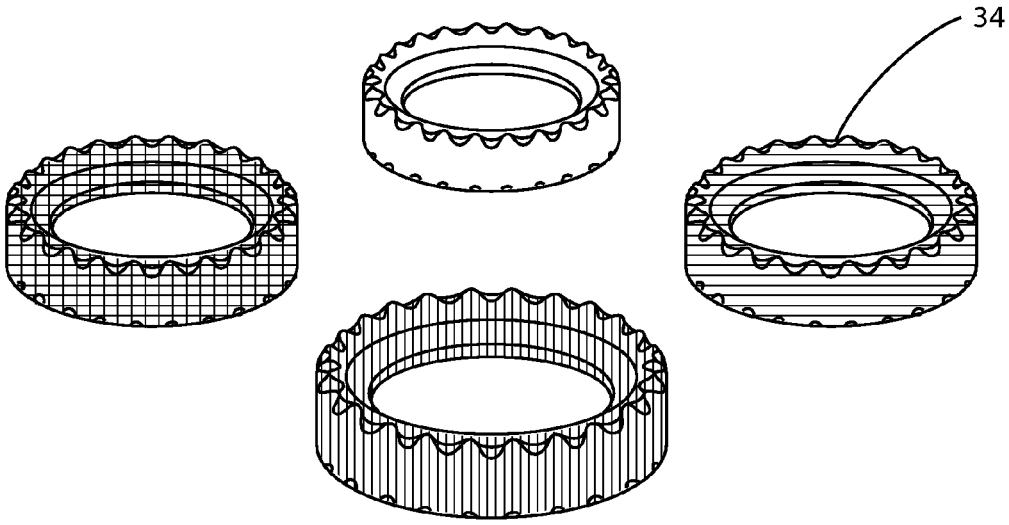
FIG. 4A and FIG. 4B show the two different types of playing markers described.

FIG. 4A shows a set of first playing markers 34 that are loosely receivable by said multiplicity of first channels 26*a-g* and said multiplicity of second channels 28*a-g*. In the preferred embodiment, the game comprises a plurality of sets of first playing markers 34 wherein each set of first playing markers 34 is distinguishably identifiable from any other set of first playing markers 34. For example, as shown in FIG. 4A, a first playing marker 34 is a round disc that has dimensions allowing it to fit into a first channel 26*a-g* or a second channel 28*a-g*. Preferably, the sets of first playing markers 34 are distinguishably identifiable by each set having a different color. The number of different colored sets corresponds to the number of allowed players.

Referring again to FIG. 3, the game further comprises a plurality of dividers 30*a-h* intermediate said first wall 10 and said second wall 14 defining said multiplicity of first channels 26*a-g* and said multiplicity of second channels 28*a-g*. Said plurality of dividers 30*a-h* are disposed to form a multiplicity of gaps defined by spaces between said multiplicity of first channels 26*a-g* and said multiplicity of second channels 28*a-g*.

Figure 4B:
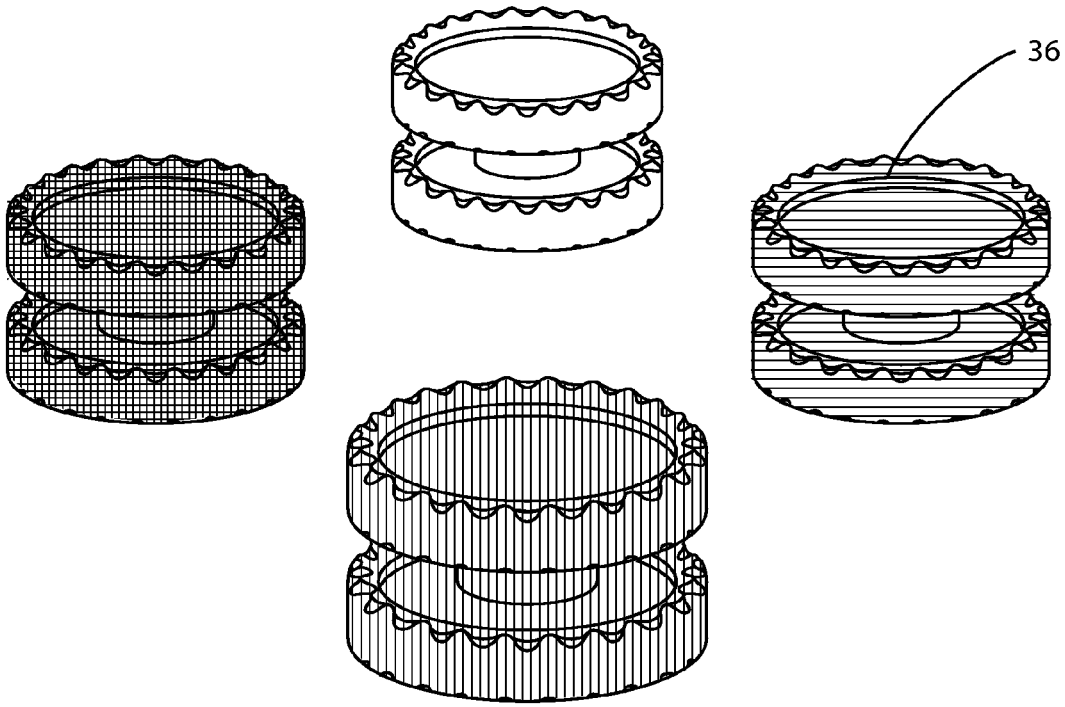

FIG. 4B shows a set of second playing markers 36 that are loosely receivable by said multiplicity of first channels 26*a-g* and said multiplicity of second channels 28*a-g* and said gaps defined by spaces between said multiplicity of first channels 26*a-g* and said multiplicity of second channels 28*a-g*. In the preferred embodiment, the game comprises a plurality of sets of second playing markers 36 wherein each set of second playing markers 36 is distinguishably identifiable from any other set of second playing markers 36. As shown in FIG. 4B, a second playing marker 36 has dimensions, herein spool shaped i.e. two layers thick, allowing it to fit into said multiplicity of first channels 26*a-g* and said multiplicity of second channels 28*a-g* and said gaps defined by spaces between said multiplicity of first channels 26*a-g* and said multiplicity of second channels 28*a-g*. The second playing markers 36 may also be referred to as blockers, and being provided as such, can change the outcome of the game by blocking opponents moves. Preferably, the sets of second playing markers 36 are distinguishably identifiable by each set having a different color. The number of different colored sets corresponds to the number of allowed players.

In a preferred embodiment the matrix is vertically suspended to facilitate receiving the playing markers 34, 36 and transparent to facilitate viewing the markers; however the matrix may be provided as opaque for example with enlarged apertures 12, 16.

Figure 1B:
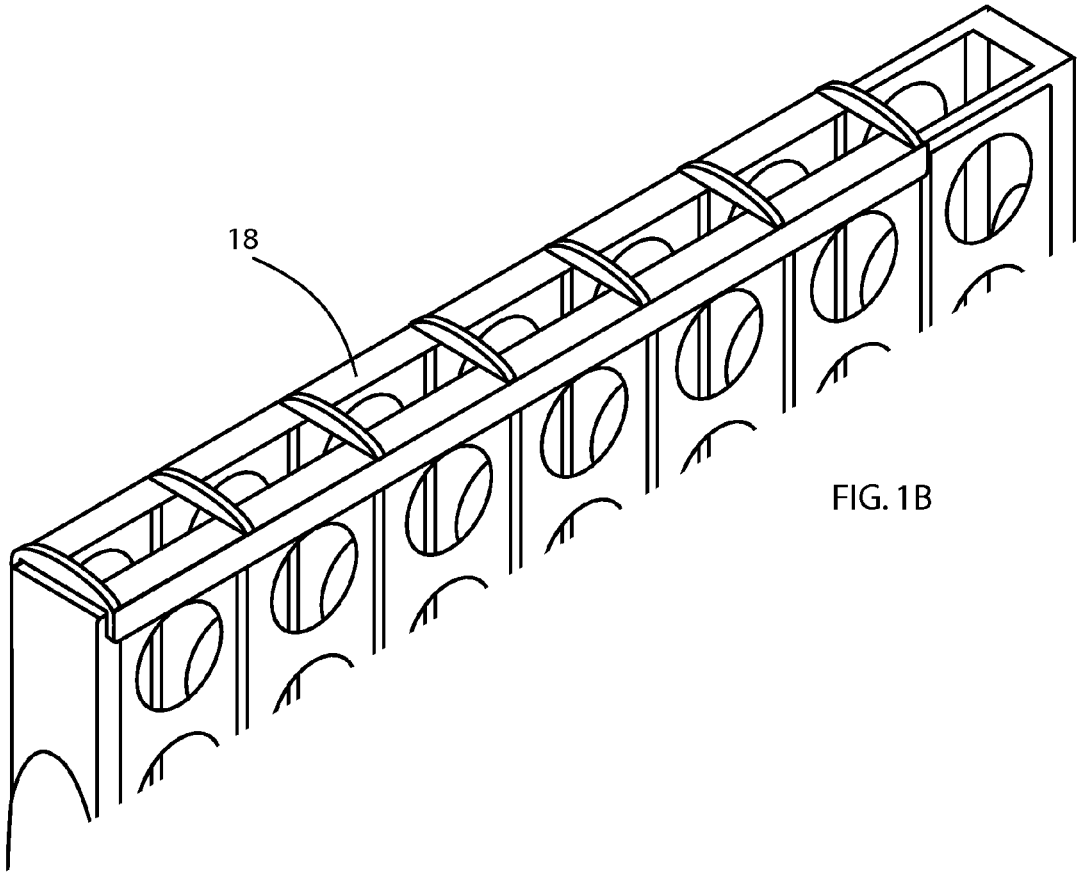
FIG. 1B shows the slideably mounted bracket in an open position.

Referring again to FIG. 1A, a preferred embodiment further comprises a first bracket 18 that is slideably mounted to said first wall 10 and said second wall 14. FIG. 1B also shows the first bracket 18. This first bracket 18 is preferably mounted to slide between an open position and a closed position. When the first bracket 18 is in the open position, a first playing marker 34 or a second playing marker 36 may be inserted into the channels. When the first bracket 18 is in the closed position, a first playing marker 34 or a second playing marker 36 may not be inserted into the channels. FIG. 1A shows the first bracket 18 in the closed position. FIG. 1B shows the first bracket 18 in the open position. The open position facilitates game play, and the closed position facilitates storage and transport.

Figure 6A:
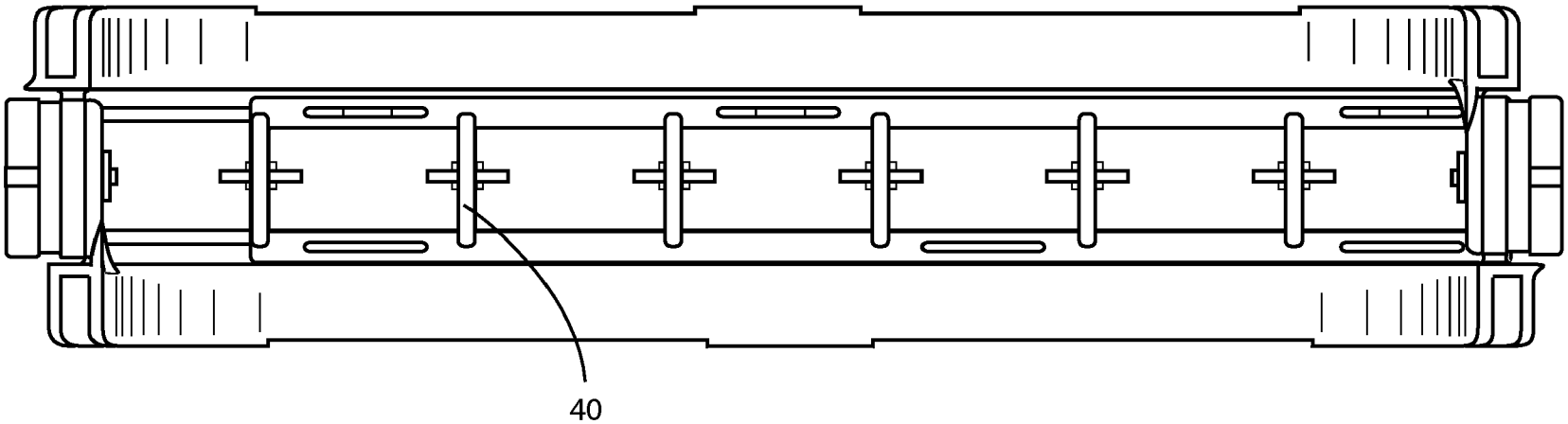
FIG. 6A and FIG. 6B show a perspective view of the bottom of the game assembly with the supporting stand folded.
Figure 6B:
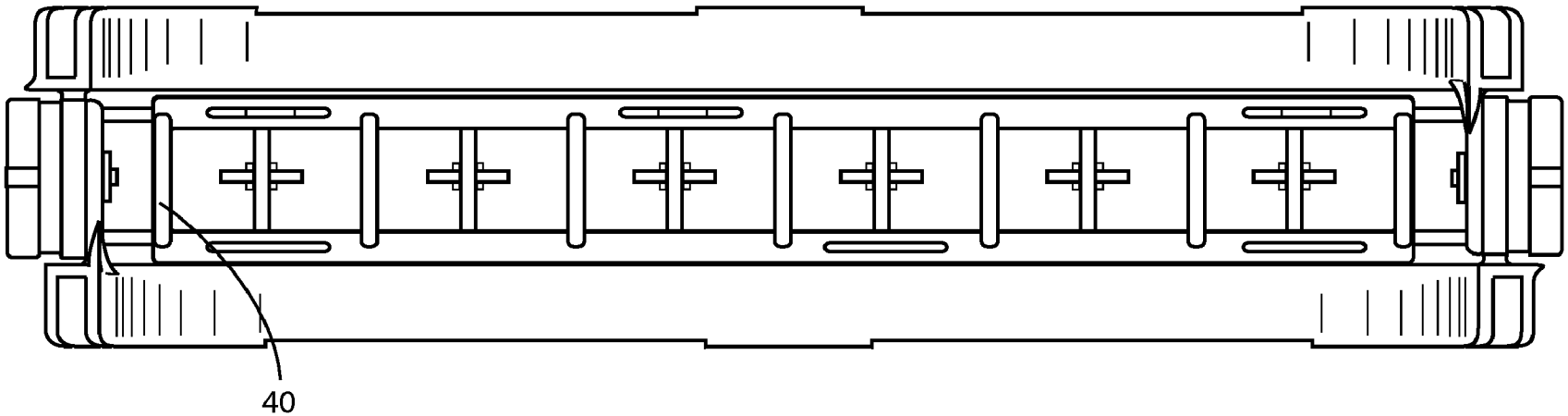

FIG. 6A and FIG. 6B show a perspective view of the bottom of the game assembly. Similarly to the first bracket 18, FIG. 6A and FIG. 6B show a preferred embodiment that further comprises a second bracket 40 that is slideably mounted to said first wall 10 and said second wall 14 on the bottom of the game assembly. This second bracket 40 is preferably mounted to slide between an open position and a closed position. When the second bracket 40 is in the open position, a first playing marker 34 or a second playing marker 36 that was inserted into the channels will fall out of the channels. When the second bracket 40 is in the closed position, a first playing marker 34 or a second playing marker 36 will not fall out of the channels. FIG. 6A shows the second bracket 40 in the open position. FIG. 6B shows the second bracket 40 in the closed position. The closed position facilitates game play, storage, and transport, and the open position facilitates emptying the game assembly to begin game play.

Figure 1C:
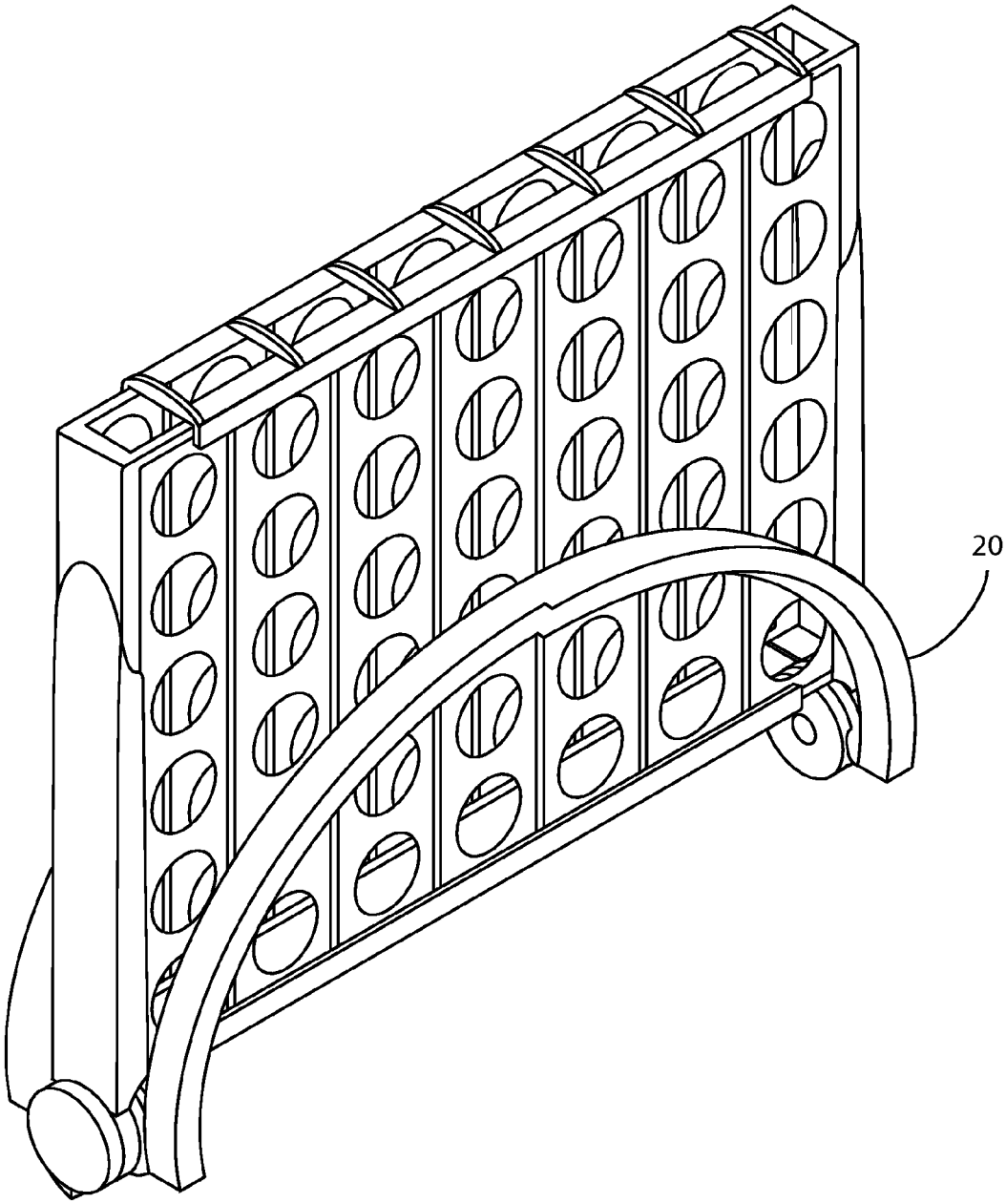
FIG. 1C shows a perspective view of the game assembly with the supporting stand in an unfolded position.
Figure 2:
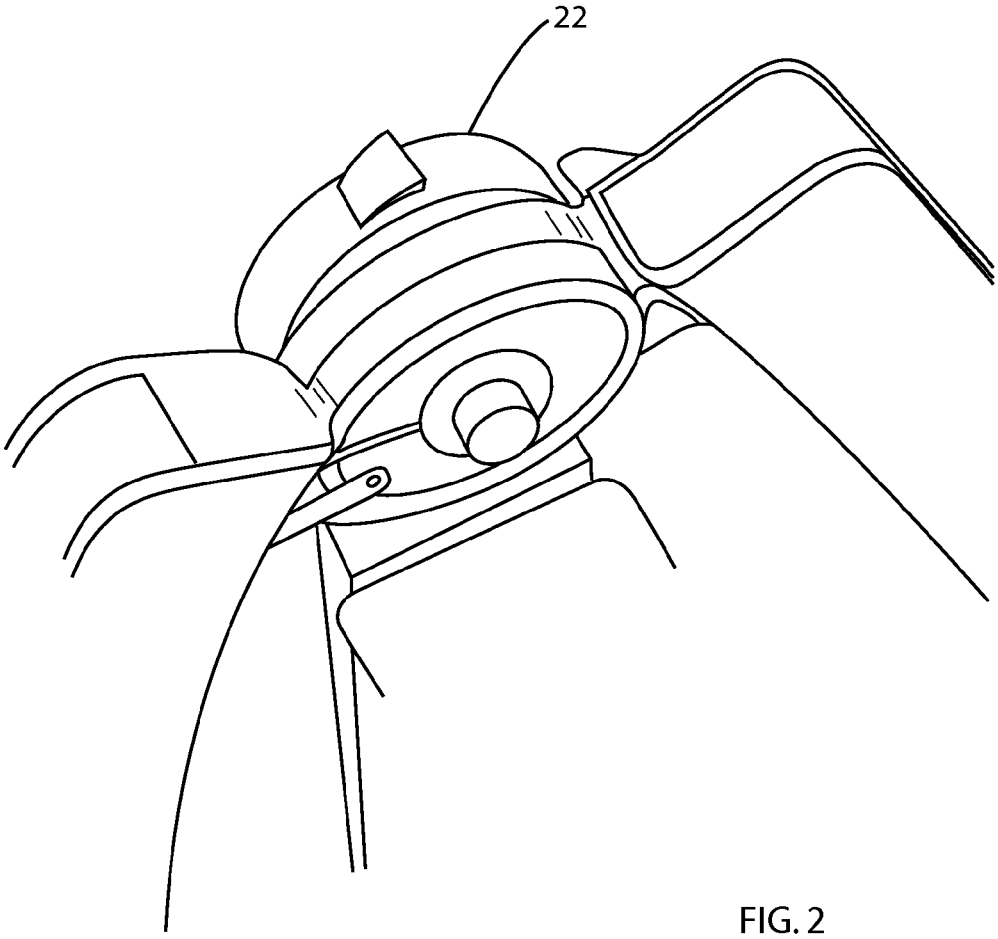
FIG. 2 shows an isolated view of the hinge mechanism used in the supporting stand.

Referring once again to FIG. 1A, a preferred embodiment further comprises a foldable stand 20 to support said vertically suspended matrix. The foldable stand 20 as shown is attached to the sides of the game assembly with vertical supports 42 that are further attached to a hinge mechanism 22 that facilitates folding and holding the foldable stand 20 in a folded position or an unfolded position. FIG. 1C shows the foldable stand 20 in the folded position. When the foldable stand 20 is in the unfolded position, the stand forms a compartment 24 for catching said sets of first playing markers 34 and said sets of second playing markers 36. Thus, when the second bracket 40 is moved from the closed position to the open position, any playing markers in the game apparatus will fall into the compartment 24. FIG. 2 shows an isolated view of a prototypical hinge mechanism 22 used in the supporting stand.

Figure 5:
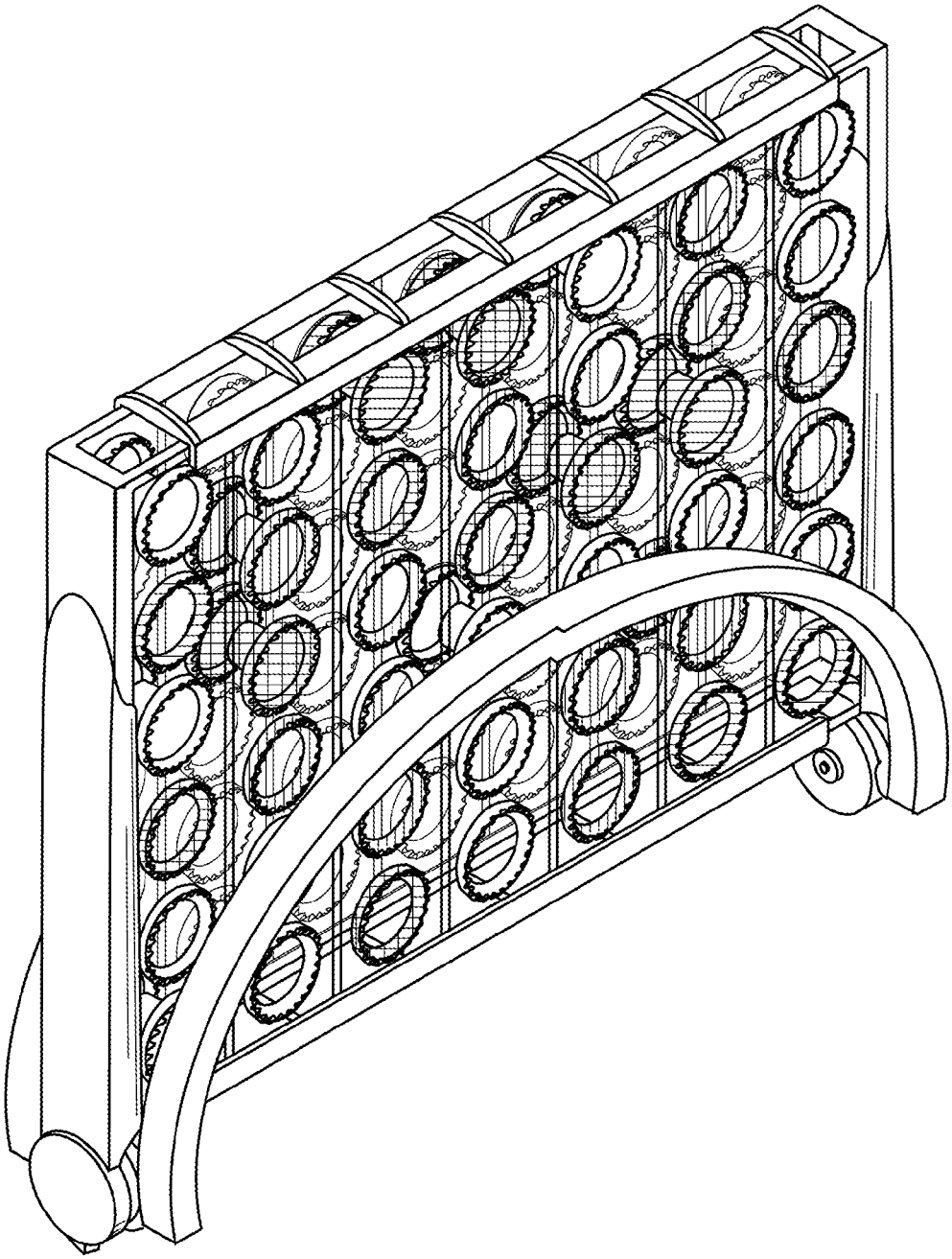
FIG. 5 shows a perspective view of the game assembly and playing markers prepared for storing or transporting.

FIG. 5 shows a perspective view of the game assembly and playing markers prepared for storing or transporting. This figure displays the first bracket 18 and the second bracket 40 in a closed position, preventing the playing markers 34, 36 from falling out of the game apparatus. This figure also shows the foldable stand 20 in the folded position, thus showing the game apparatus holding all the playing markers 34, 36 in a compact form that is useful for storing or transporting the game.

Figure 7:
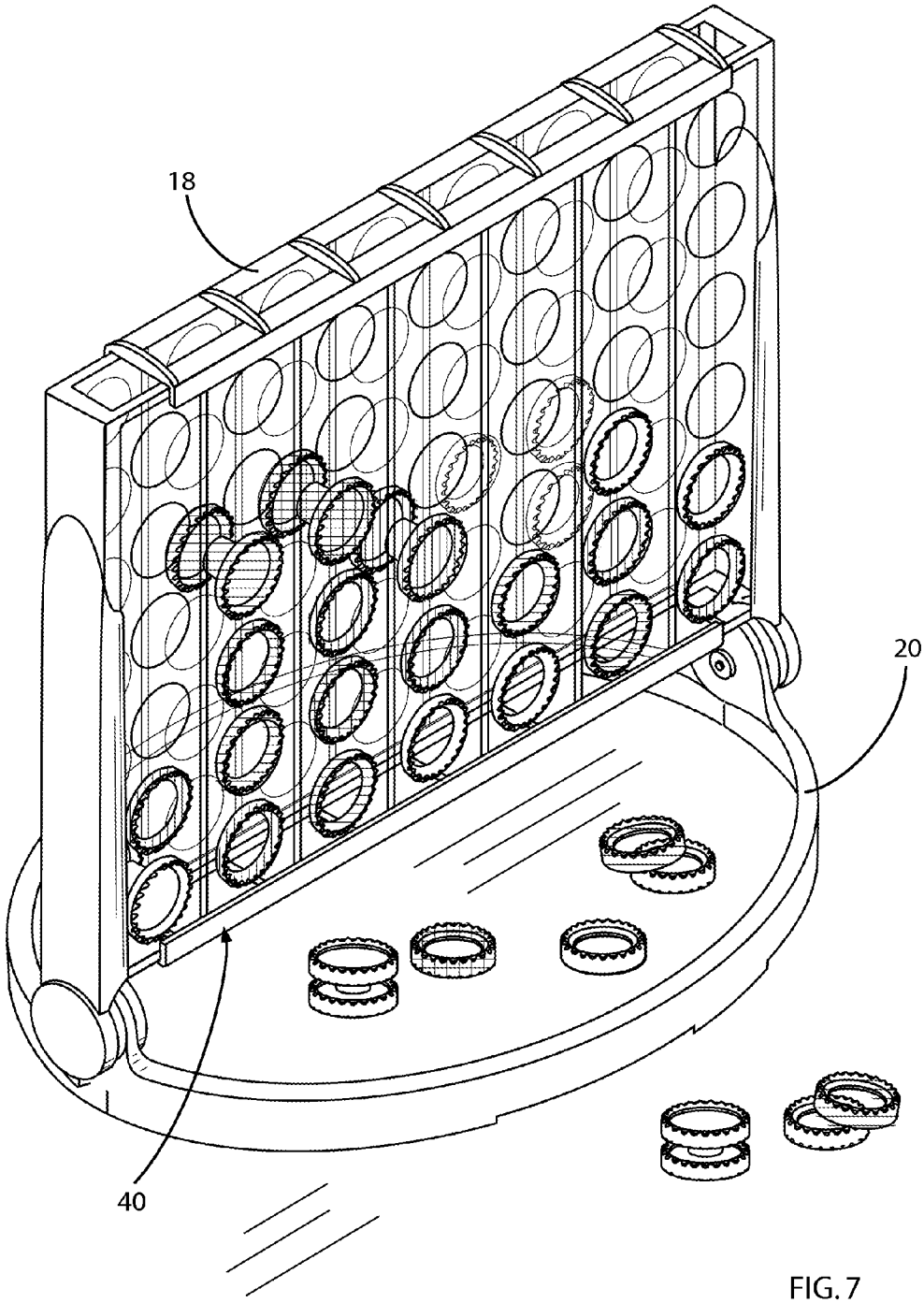
FIG. 7 shows a perspective view of the game assembly during game play.

FIG. 7 shows a perspective view of the game assembly during game play. This figure is shown with the first bracket 18 in the open position so that the players may insert the playing markers into the channels. The second bracket 40 is in the closed position to prevent the playing markers from falling out of the bottom of the game apparatus during game play. The foldable stand 20 is unfolded to catch and contain the playing markers when the second bracket 40 is moved into the open position after a game is completed. FIG. 7 also shows the distinguishable sets of first playing markers 34 either in a first channel 26*a-g* or a second channel 28*a-g* and the distinguishable sets of second playing markers 36 filling the channels and the gaps.

The remainder of this description details an example of the game play of the preferred embodiment. The example described is for two to four players ages six and older.

The object of the game is to take turns dropping the playing markers into the vertically suspended matrix to create a line of four identically colored playing markers in a row either horizontally, vertically, or diagonally in a single plane, or across both planes. The object of the game can also be accomplished by weaving four identically colored playing markers between two sides of the matrix. If two of the same color first playing markers are in the same position but in different planes, this only counts as one of the four required in a row.

The contents include the vertically suspended matrix and four groups of playing markers, each group having a unique color. Each group of playing markers includes sixteen first playing markers 34 and two second playing markers 36.

The game apparatus initially appears as shown in FIG. 5. Referring back to FIG. 1A, a player must hold the apparatus in a vertical position and move the foldable stand 20 to the unfolded position. The game apparatus will support itself in a vertical position. A player then moves the first bracket 18 from the closed position to the open position and the second bracket 40 from the closed position to the open position. The stored game markers will fall into the compartment 24. A player must then move the second bracket 40 back to the closed position. Next, each player takes all the playing markers of a single color for use during the game. If four players are playing, each player only gets one second playing marker 36.

The youngest player goes first and play passes to the left. On each turn, a player must drop either a first playing marker 34 or a second playing marker 36 into the matrix. A first playing marker 34 can be dropped into either a first channel 26*a-g* or a second channel 28*a-g*. A second playing marker 36 can only be dropped simultaneously into a first channel 26*a-g*, a second channel 28*a-g*, and the gap between the two channels. When a player uses a second playing marker 36, that player may leave empty matrix spaces below that playing marker. Play continues until one player wins by creating a line of four identically colored playing markers in a row either horizontally, vertically or diagonally. This may also be accomplished by weaving between two sides of the matrix.

To start another game, one must clear the matrix by moving the second bracket 40 to the open position, allowing the playing markers to fall into the compartment 24. Then, a player must move the second bracket 40 back to the closed position, divide the playing markers between the players and start the game again.

When finished playing, one can prepare the game for storing or transporting by placing the playing markers into the matrix with the second bracket 40 in the closed position, moving the first bracket 18 to the closed position and moving the foldable stand 20 to the folded position.

It should be appreciated that a wide range of changes and modifications may be made to the embodiment as described herein. It is intended that the foregoing detailed description be regarded as illustrative rather than limiting. While there has been illustrated and described a particular embodiment of the apparatus, it will be appreciated that numerous changes and modifications will occur to those skilled in the art, and it is intended in the appended claims to cover those changes and modifications which fall within the true spirit and scope of the present apparatus.

What is claimed is:

1. An abstract strategy pattern building board game comprising:

a first wall comprising a multiplicity of first apertures;

a second wall comprising a multiplicity of second apertures;

a multiplicity of dividers spaced intermediate and parallel to said first wall and said second wall;

a multiplicity of first channels disposed between said dividers and said first wall;

a multiplicity of second channels disposed between said dividers and said second wall; a set of first playing markers, each first playing marker being receivable at said multiplicity of first apertures with one of said multiplicity of first channels; and a set of second playing markers, each second marker configured as combination of two first playing markers and being receivable at said multiplicity of first apertures and at said multiplicity of second apertures together with one of said multiplicity of first channels and with one of said multiplicity of second channels.

2. The game recited in claim 1 comprising a set of second playing markers, each second playing marker being receivable at said multiplicity of first apertures and at said multiplicity of second apertures together with one of said multiplicity of first channels and with one of said multiplicity of second channels.

3. The game recited in claim 1 wherein said multiplicity of dividers are disposed to form a multiplicity of gaps defined by spaces between said multiplicity of first channels and said multiplicity of second channels.

4. The game recited in claim 3 comprising a set of second playing markers, each second playing marker being receivable at said multiplicity of first apertures and at said multiplicity of second apertures together with one of said multiplicity of first channels, with one of said multiplicity of gaps, and with one of said multiplicity of second channels.

5. The game recited in claim 4 wherein said multiplicity of dividers are disposed to form seven gaps defined by spaces between said multiplicity of first channels and said multiplicity of second channels.

6. The game recited in claim 3 further comprising a bracket that is slideably mounted at said multiplicity of first channels, said multiplicity of second channels, and at said gaps defined by spaces between said multiplicity of first channels and said multiplicity of second channels.

7. The game recited in claim 1 further comprising a plurality of sets of first playing markers wherein each set of first playing markers is distinguishably identifiable from any other set of first playing markers.

8. The game recited in claim 1, comprising said first apertures and said second apertures arranged to form a matrix with said first wall and said second wall being transparent.

9. The game recited in claim 1 wherein said first wall and said second wall are arranged to form a vertically suspended matrix, further comprising a stand to support said vertically suspended matrix wherein said stand is foldable and wherein said stand forms a compartment for catching said playing markers.

10. An abstract strategy pattern building board game comprising:

a first wall comprising a multiplicity of first apertures;

a second wall comprising a multiplicity of second apertures;

a multiplicity of dividers spaced intermediate and parallel to said first wall and said second wall;

seven first channels disposed between said dividers and said first wall;

seven second channels disposed between said dividers and said second wall;

a set of first playing markers, each first playing marker being receivable at said multiplicity of first apertures with one of said seven first channels; and a set of second playing markers, each second playing marker configured as combination of two first playing markers and being receivable at said multiplicity of first apertures and at said multiplicity of second apertures together with one of said seven first channels and with one of said seven second channels.

11. The game recited in claim 10 wherein said multiplicity of dividers are disposed to form seven gaps defined by spaces between said multiplicity of first channels and said multiplicity of second channels.

12. The game recited in claim 11 wherein one of said second playing markers is receivable at said multiplicity of first apertures and at said multiplicity of second apertures together with one of said multiplicity of first channels, with one of said seven gaps, and with one of said multiplicity of second channels.

13. The game recited in claim 12 comprising a plurality of sets of first playing markers wherein each set of first playing markers is distinguishably identifiable from any other set of first playing markers, and further comprising a plurality of sets of second playing markers wherein each set of second playing markers is distinguishably identifiable from any other set of second playing markers.

* * * * *